US007651381B2

(12) United States Patent
Chuang

(10) Patent No.: US 7,651,381 B2
(45) Date of Patent: Jan. 26, 2010

(54) CONTACT TERMINAL AND ELECTRIC CONNECTOR USING THE SAME

(75) Inventor: Shun-Jung Chuang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/077,561

(22) Filed: Mar. 20, 2008

(65) Prior Publication Data

US 2008/0233810 A1 Sep. 25, 2008

(30) Foreign Application Priority Data

Mar. 20, 2007 (CN) ..... 2007 2 0035601 U

(51) Int. Cl.
*H01R 4/48* (2006.01)

(52) U.S. Cl. ..... 439/862; 439/66

(58) Field of Classification Search ..... 439/862, 439/884, 746, 66, 81
See application file for complete search history.

(56) References Cited

U.S. PATENT DOCUMENTS

| | | | | |
|---|---|---|---|---|
| 4,275,374 | A * | 6/1981 | Chaucer | 337/197 |
| 5,002,502 | A * | 3/1991 | Hill | 439/536 |
| 5,967,836 | A * | 10/1999 | Bailey | 439/534 |
| 6,544,069 | B1 * | 4/2003 | Enriquez et al. | 439/534 |
| 6,616,485 | B2 * | 9/2003 | Harasawa et al. | 439/630 |
| 7,029,287 | B2 * | 4/2006 | Matsunaga et al. | 439/65 |
| 7,088,237 | B2 * | 8/2006 | Arcens | 340/539.13 |
| 2005/0130510 | A1 * | 6/2005 | Zheng et al. | 439/862 |

* cited by examiner

*Primary Examiner*—Tho D Ta
*Assistant Examiner*—Travis Chambers
(74) *Attorney, Agent, or Firm*—Ming Chieh Chang; Wei Te Chung; Andrew C. Cheng

(57) ABSTRACT

A contact terminal, comprising a flat portion, a first bent portion extending from the flat portion, and defining an opening structure therein; a second bent portion extending from the first bent portion; and a contact engaging portion extending from the second bent portion, and including a downward tab extending into the opening structure of the first bend portion when depressed.

4 Claims, 2 Drawing Sheets

CONTACT TERMINAL AND ELECTRIC CONNECTOR USING THE SAME

BACKGROUND OF THE INVENTION

1. Field of the invention

The present invention generally relates to a contact terminal and, more particularly, to a contact terminal used in an electric connector for reducing the touch between a contact engaging portion and a first bent portion of the contact terminal.

2. Description of Related Art

T.W. Patent Application No. 089205720 discloses a terminal structure for using in a battery connector and which has a base portion. The base portion comprises a first bent portion and a second bent portion extending in opposite direction from the first bent portion. The terminal structure further comprises a mounting portion extending from an end portion of the first bent portion and a contact engaging portion extending from a free end of the second bent portion. The contact engaging portion includes a downward tab toward the base portion.

However, in practical use, a battery exerts a normal force to the contact engaging portion and because of the design of the downward tab of the contact engaging portion extending toward the base portion, the battery will inflict an excess force between the downward tab of the contact engaging portion and the base portion. Therefore, the downward tab of the contact engaging portion and the base portion tend to twist under pressure and maybe can reduce the life span.

Hence, an improved electric connector is desired to overcome above problem.

SUMMARY OF THE INVENTION

An object of the present invention is to provide a contact terminal in order to reduce probability about an alteration of shape by pressure or stress.

In order to achieve above-mentioned object, a contact terminal, comprising a flat portion, a first bent portion extending from the flat portion, and defining an opening structure therein; a second bent portion extending from the first bent portion; and a contact engaging portion extending from the second bent portion, and including a downward tab extending into the opening structure of the first bend portion when depressed. And in this invention, the first bent portion devises the opening structure for allowing downward tab of the contact engaging portion extending through in order to reduce probability about an alteration of shape by pressure or stress and increase lifespan of the contact terminal.

Other objects, advantages and novel features of the present invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
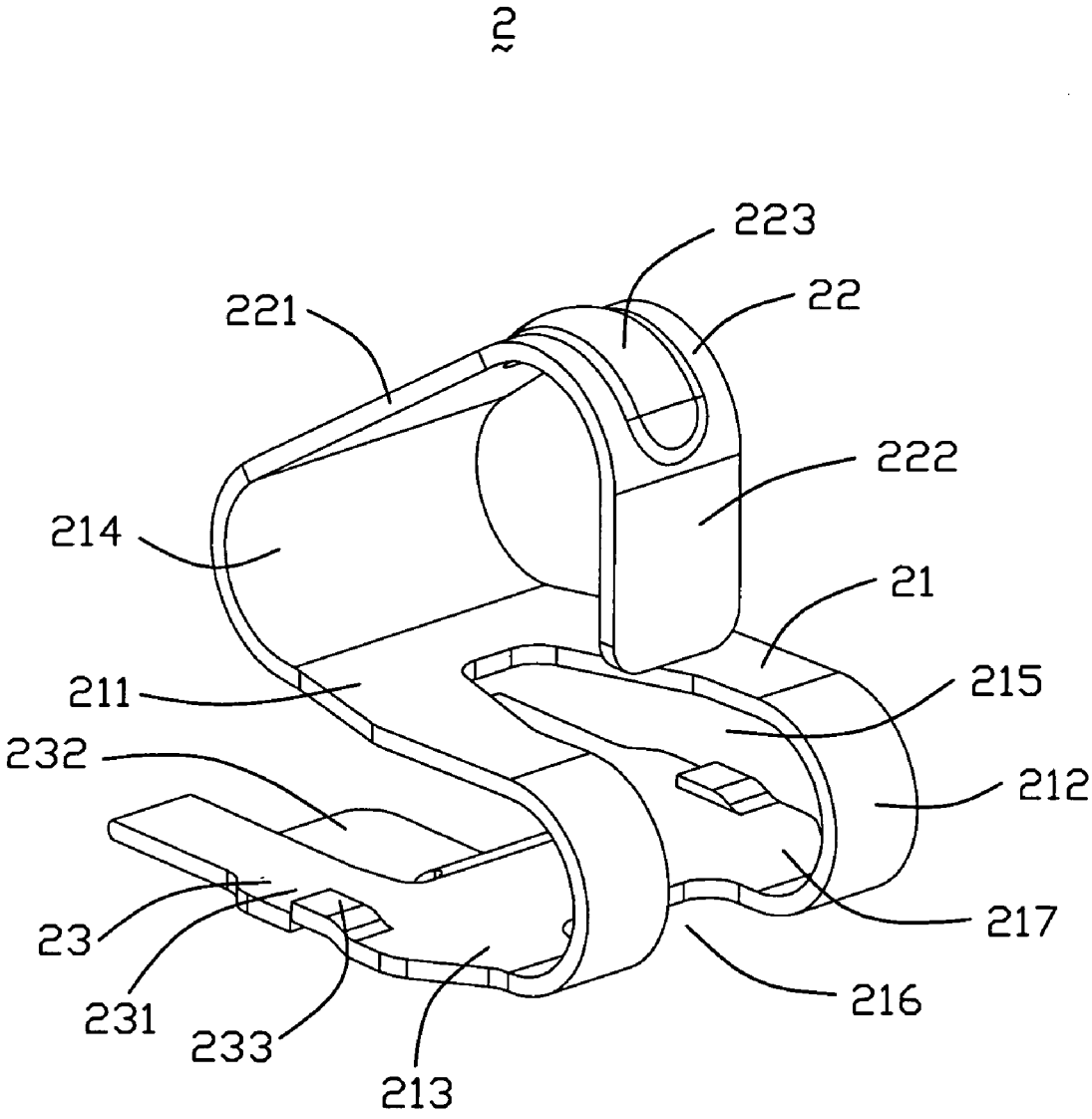
FIG. 1 is a perspective view of contact terminal in accordance with the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
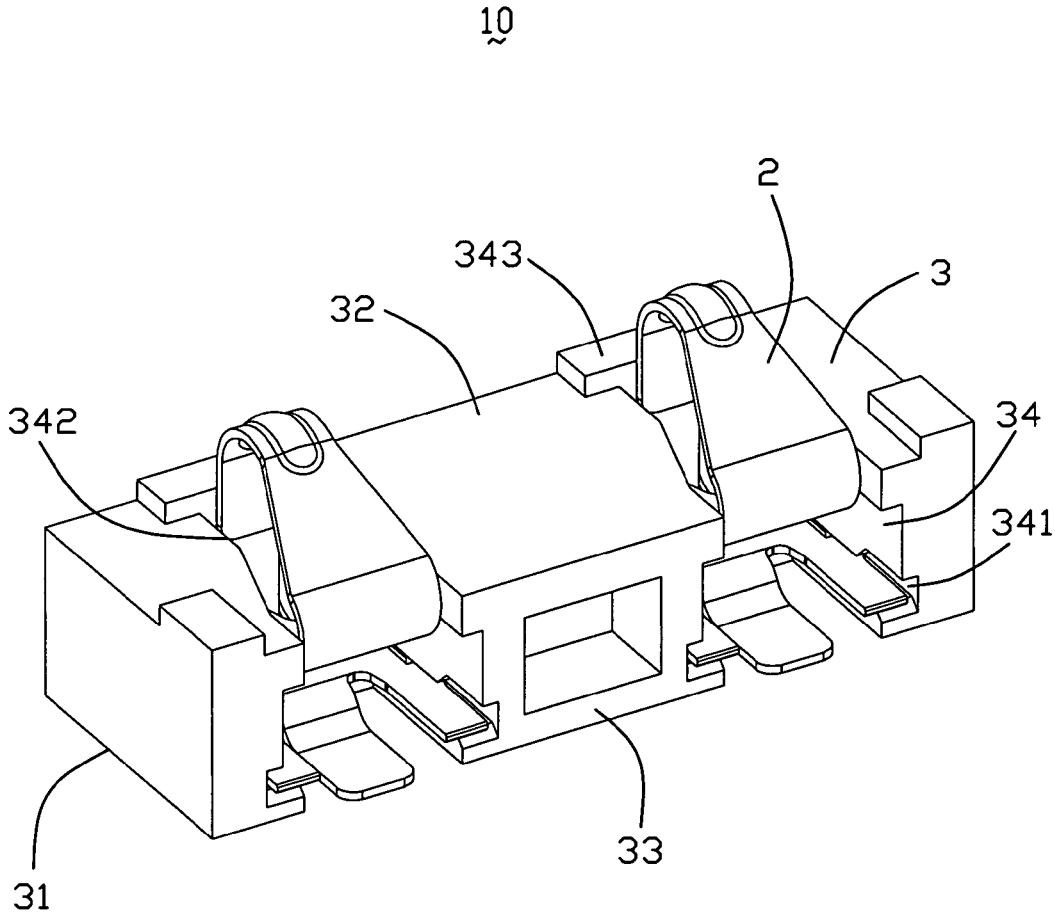
FIG. 2 is a front assembled perspective view of an electric connector in accordance with the present invention.

Referring now to FIG. 1 and FIG. 2, a contact terminal 2 of the present invention used in an electric connector 10 is similar with the prior art and connects between an electronic component (not shown) and a circuit board (not shown).

The electric connector 10 comprises an insulative housing 3 and a plurality of contact terminals 2.

The insulative housing 3 comprises a mounting surface 31 which is positioned proximate to the circuit board, a mating interface 32 for supporting the electronic component and a rear surface 33 connecting the mounting surface 31 and the mating interface 32. The insulative housing 3 defines a plurality of terminal channels 34 extending from the rear surface 33 and through the mounting surface 31 and the mating interface 32. The terminal channel 34 defines a plurality of mounting grooves 341 adjacent to the mounting surface 31, a protrusion 342 extending along horizontal direction from the opening (not shown) of the mating interface 32, and a vertical portion 343 opposite to the rear surface 33.

Each contact terminal 2 is respectively received in the corresponding terminal channels 34. The contact terminal 2 comprises a body portion 21, a contact engaging portion 22 extending from one end of the body portion 21 and a mounting portion 23 extending from the other end of the body portion 21.

The body portion 21 has a first flat portion 211, a first bent portion 212 extending downwardly from one end of the first flat portion 211, a second flat portion 213 connecting with the other end of the first bent portion 212 and opposite to the first flat portion 211 in some distance, and a second bent portion 214 extending upwardly from the other end of the first flat portion 211. The first and second opposite flat portions 211, 213 are forming a receiving space (not shown). The connecting corner of the first flat portion 211 and the first bent portion 212 define a first opening 215 so as to make the terminal part of the contact engaging portion 22 inserting. Similarly, The connecting corner of the first bent portion 212 and the second flat portion 213 define a second opening 216 having the same width with the first opening 215. The first opening 215 and the second opening 216 respectively extend along the first bent portion 212 and communication with each other, and further form a opening structure 217 to provide the terminal part of the contact engaging portion 22 inserting. With this design, the opening structure 217 must have proper width for the terminal part of the contact engaging portion 22 inserting and have proper depth for receiving terminal part of the contact engaging portion 22 in said receiving space.

The contact engaging portion 22 has a first arm 221 and a second arm 222, the second arm 222 integrally upwardly extends from the other end of the second bent portion 214 first and then bent a sharp with a generally "Λ" shape extends laterally integrally to form the first arm 221, and the extends direction of the first arm 221 toward to the first opening 215. A contact point 223 is located between the first arm 221 and the second arm 222, preferably at the point of the generally "Λ" shape.

The mounting portion 23 connecting with the other end of the second flat portion 213 comprises a pair of fixing portions 231 extending respectively along horizontal direction from the ends of the side of the second flat portion 213 and a soldering portion 232 extending downwardly from the second flat portion 213 and between the fixing portions 231. The connecting portions of the fixing portions 231 and the second flat portion 213 respectively define a support chip 233 toward the first flat portion 211. The soldering portion 232 and the mounting surface 31 of the insulative housing 3 are approximately in a same plane.

Referring to FIG. 2, in assembly, the contact terminal 2 can be inserted into the corresponding terminal channels 34 of the insulative housing 3 from the rear surface 33 of the insulative housing 3. When the contact terminal 2 is inserted into the corresponding terminal channels 34 of the insulative housing 3 from the rear surface 33 of the insulative housing 3, the second flat portion 213 and the fixing portions 231 received in the mounting grooves 341 for making the contact terminal 2 firmly; the protrusion 342 of the housing 3 controls the distance of the first flat portion 211 and the second flat portion 213 for having a proper depth in receiving space; the first arm 221 having a touch with the vertical portion 343 for gliding along the vertical portion 343. Without doubt, the soldering portion 232 of the contact terminal 2 locates the solder by its outside surface.

During use, the contact engaging portion 22 of the contact terminal 2 inclines toward the body portion 21 after a battery (not shown) is assembled to the connector 10. And in this invention, the body portion 21 devises the first opening 215 for allowing the first arm 221 of the contact engaging portion 22 extending through in order to reduce probability about an alteration of shape by pressure or stress and increase lifespan of the contact terminal 2.

Although the present invention has been illustrated and described with respect to exemplary embodiment thereof, it should be understood by those skilled in the art that the various changes, omissions and additions may be made therein and thereto without departing from the spirit and scope of the present invention as set forth in the appended claims.

What is claimed is:

1. An electric connector, comprising:

a housing defining a mating interface and a mounting surface with at least passage defined therein;

a contact terminal defines a mounting portion fixed in the passage having a soldering portion split from a middle thereof and extending downwardly from the middle of the mounting portion and adjacent to the mounting surface, a flat portion above the mounting portion, a first bent portion joining the mounting portion and the flat portion with an opening structure therein, a second bent portion extending upwardly from the flat portion, and a contact engaging portion extending upwardly from the second bent portion and beyond the mating interface, and including a downward tab extending into the opening structure of the first bent portion when depressed;

wherein the opening structure extending from the first bent portion to the flat portion, comprising a first opening and a second opening connecting with the first opening.

2. The electric connector of claim 1 in which the first opening located the second opening.

3. An electrical connector comprising:

an insulation housing defining a passageway having guiding means allowing a corresponding terminal to be assembled thereinto along a horizontal direction while said passageway extends throughout the housing in a vertical direction;

said terminal including a retention section closer to a bottom face of the housing and extending essentially in the horizontal direction with a mounting tab stamped therefrom, and further including a mating section extending upwardly out of an upper face of the housing; and said terminal further defining a lying U-shaped body portion having upper and lower arms linked by a first bent section under a condition that the lower arm is connected to the retention section, and the upper arm is connected to the mating section via a second bent section; wherein the first bent section is opposite to said second bent section;

an arm extends downwardly from an end of the mating section opposite to the second bent section and up and down moveable in an opening which extends along a centerline of the U-shaped body portion, including said upper arm, said first bent section and said lower arm.

4. An electric connector, comprising:

a housing defining a mating interface and a mounting surface with at least passage defined therein;

a contact terminal defines a mounting portion fixed in the passage having a soldering portion split from a middle thereof and extending downwardly from the middle of the mounting portion and adjacent to the mounting surface, a flat portion above the mounting portion, a first bent portion joining the mounting portion and the flat portion with an opening structure therein, a second bent portion extending upwardly from the flat portion, and a contact engaging portion extending upwardly from the second bent portion and beyond the mating interface, and including a downward tab extending into the opening structure of the first bent portion when depressed;

wherein the first bent portion and the second bent portion toward each other with all substantially U-shaped.

* * * * *